US007731482B2

(12) United States Patent
Lagrange et al.

(10) Patent No.: US 7,731,482 B2
(45) Date of Patent: Jun. 8, 2010

(54) BUCKET VIBRATION DAMPER SYSTEM

(75) Inventors: Benjamin Arnette Lagrange, Greer, SC (US); Randall Richard Good, Simpsonville, SC (US); Gary Charles Liotta, Simpsonville, SC (US); Jon Robert DeLong, Simpsonville, SC (US); Matthew Durham Collier, Simpsonville, SC (US); James William Vehr, Travelers Rest, SC (US); Anthony Aaron Chiurato, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 471 days.

(21) Appl. No.: 11/423,789

(22) Filed: Jun. 13, 2006

(65) Prior Publication Data

US 2007/0286734 A1 Dec. 13, 2007

(51) Int. Cl.
*F01D 5/26* (2006.01)

(52) U.S. Cl. ..... 416/190; 416/193 A; 416/500

(58) Field of Classification Search ..... 415/119, 415/139; 416/93 R, 190, 192, 193 A, 219 R, 416/500, 248

See application file for complete search history.

(56) References Cited

U.S. PATENT DOCUMENTS

| | | | | | |
|---|---|---|---|---|---|
| 5,156,528 | A | | 10/1992 | Bobo | |
| 5,281,097 | A | | 1/1994 | Wilson et al. | |
| 5,478,207 | A | * | 12/1995 | Stec | 416/219 R |
| 5,746,578 | A | * | 5/1998 | Brassfield et al. | 416/190 |
| 5,749,705 | A | * | 5/1998 | Clarke et al. | 416/190 |
| 5,785,499 | A | * | 7/1998 | Houston et al. | 416/248 |
| 5,827,047 | A | * | 10/1998 | Gonsor et al. | 416/193 A |
| 5,924,699 | A | * | 7/1999 | Airey et al. | 277/411 |
| 6,354,803 | B1 | | 3/2002 | Grover et al. | |
| 6,390,775 | B1 | | 5/2002 | Paz | |
| 6,761,536 | B1 | * | 7/2004 | Bash et al. | 416/193 A |
| 6,776,583 | B1 | | 8/2004 | Wang et al. | |
| 6,851,932 | B2 | * | 2/2005 | Lagrange et al. | 416/190 |
| 6,932,575 | B2 | * | 8/2005 | Surace et al. | 416/193 A |
| 7,121,802 | B2 | * | 10/2006 | Athans et al. | 416/193 A |
| 7,322,797 | B2 | * | 1/2008 | Lee et al. | 416/193 A |
| 2005/0079062 | A1 | * | 4/2005 | Surace et al. | 416/248 |

* cited by examiner

*Primary Examiner*—Christopher Verdier
(74) *Attorney, Agent, or Firm*—Sutherland Asbill & Brennan LLP

(57) ABSTRACT

A damping system for a turbine bucket. The damping system includes a damper pocket with a variable tangential depth and a damper pin positional within the damper pocket.

10 Claims, 2 Drawing Sheets

BUCKET VIBRATION DAMPER SYSTEM

TECHNICAL FIELD

The present application relates generally to gas turbines and more particularly relates to turbine buckets having a bucket damping system for minimizing bucket vibration.

BACKGROUND OF THE INVENTION

Gas turbines generally include a rotor with a number of circumferentially spaced buckets. The buckets generally include an airfoil, a platform, a shank, a dovetail, and other elements. The dovetail is positional about the rotor and secured therein. The airfoils project into the gas path so as to convert the kinetic energy of the gas into rotational mechanical energy. During engine operation, vibrations may be introduced into the turbine buckets that can cause premature failure of the buckets if not adequately dissipated.

Many different forms of vibration dampers are known. One example is found in commonly owned U.S. Pat. No. 6,851,932, entitled "VIBRATION DAMPER ASSEMBLY FOR THE BUCKETS OF A TURBINE." The dampers shown therein may be used in the 6C-stage 2 bucket as is offered by General Electric Company of Schenectady, N.Y. The 6C-stage 2 bucket may experience relatively high vibratory stresses during, for example, transient operations.

Although these known dampers may be largely adequate during typical operations, there is a desire to improve overall damper effectiveness, axially and radially restrain the damper, prohibit rotation of the damper during transient operations such as startups and shutdowns, and ensure proper installation of the damper. These goals preferably may be accommodated and achieved without the loss or reduction of overall system efficiency.

SUMMARY OF THE INVENTION

The present application thus describes a damping system for a turbine bucket. The damping system includes a damper with a variable tangential depth and a damper pin positioned within the damper pocket.

The bucket includes a convex side and the damper pocket is positioned on the convex side. The bucket also includes a concave side and the bucket includes an undercut on the concave side. The undercut includes an angled surface. The bucket includes a pair of supports positioned about the damper pocket. The bucket includes an airfoil and the variable tangential depth of the damper pocket is the least underneath the airfoil. The damper pocket includes a pocket angled surface and the damper pin includes a pin angled surface. The damper pocket is machined or cast into the bucket. The damper pocket may include a pair of enclosures. The damper pin includes a pair of bosses.

The application further describes a damping system for a turbine bucket. The damping system includes a cast damper pocket with a pair of side enclosures and a damper pin positioned within the damper pocket. The cast damper pocket includes a variable tangential depth. The bucket includes an airfoil and the variable tangential depth of the damper pocket is the least underneath the airfoil.

These and other features of the present application will become apparent to one of ordinary skill in the art upon review of the following detailed description when taken in conjunction with the drawings and the appended claims.

DETAILED DESCRIPTION

Figure 1:
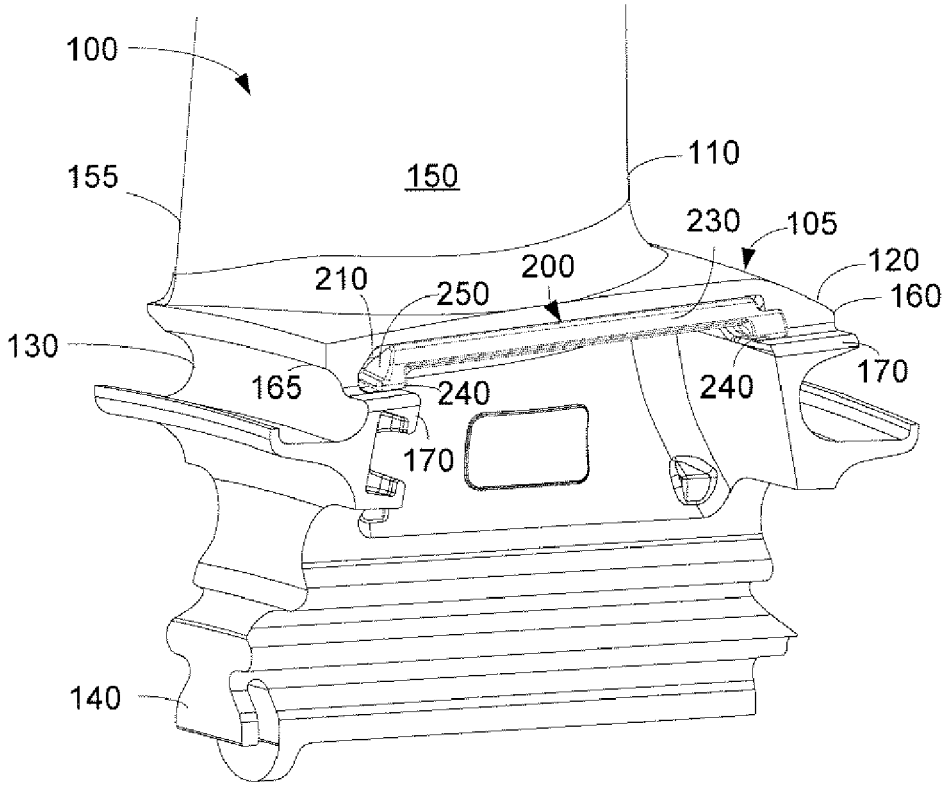
FIG. 1 is a perspective view of the bucket vibration damping system as is described herein.
Figure 2:
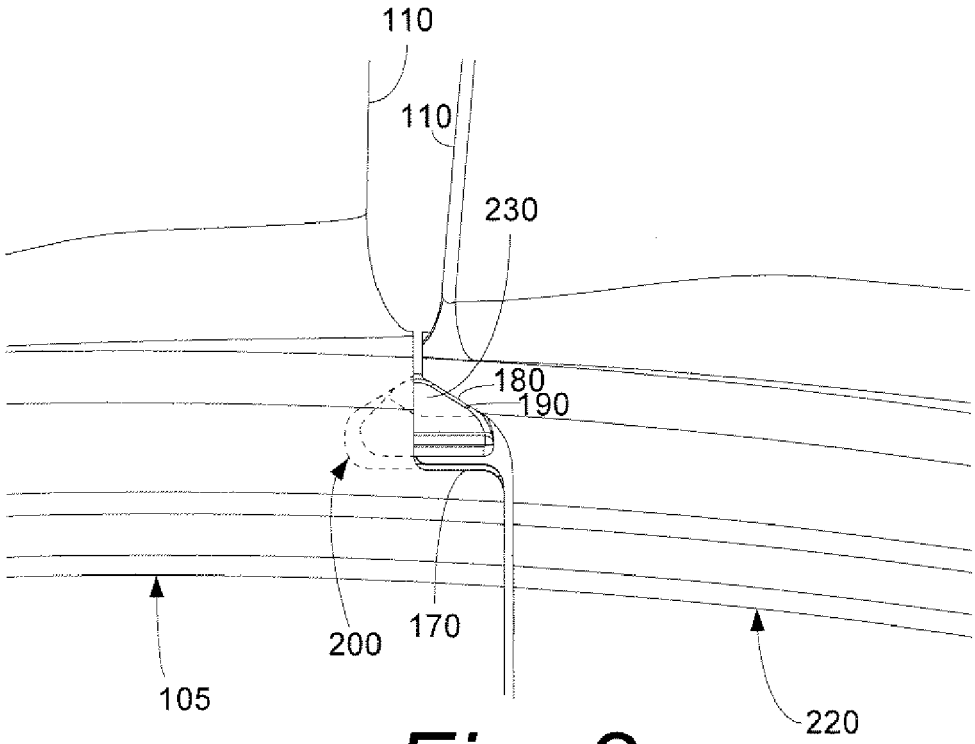
FIG. 2 is a side plan view of bucket vibration damping system of FIG. 1 as positioned within two adjoining buckets.

Referring now to the drawings, in which like numerals refer to like elements throughout the several views, FIGS. 1 and 2 illustrate a bucket damping system 100 as is described herein. The bucket damping system 100 includes a number of buckets 105. The buckets 105 may include a bucket airfoil 110, a platform 120, a shank 130, a dovetail 140, and other elements. It will be appreciated that the bucket 105 shown is one of a number of circumferentially spaced buckets 105 secured to and about the rotor of a turbine. As described above, turbines generally have a number of rotor wheels having axial or slightly off axis dovetail-shaped openings for receiving the dovetail 140 of the bucket 105. Likewise, the airfoils 110 project into the gas stream so as to enable the kinetic energy of the stream to be converted into mechanical energy through the rotation of the rotor.

The airfoil 110 includes a convex side 150 and a concave side 155. Likewise, the airfoil platform 120 includes a leading edge 160 and a trailing edge 165 extending between the convex side 150 and the concave side 155. A pair of generally axially spaced support ledges 170 may be positioned along the convex side 155 of the bucket 105. Likewise, an undercut 180 may be positioned within the bucket platform 120 from the leading edge 160 to the trailing edge 165 along the concave side 150 on the other end. The undercut 180 includes an angled surface 190 that may extend the full axial length of the bucket 105.

FIGS. 1 and 2 also show a damper pocket 200 as is described herein. The damper pocket 200 may be positioned just above the support ledges 170 on the convex side 150. The damper pocket 200 may have a tangential depth that may vary within the bucket platform 120. The variable tangential depth accommodates effective damping while minimizing bucket stresses. The pocket 200 may be deeper at the leading and trailing ends 160, 165 away from the load path of the airfoil 110. Specifically, the damper pocket 200 may be shallower under the airfoil hi-C location. (The point at which the gas flow reverses its direction on the convex side 150 of the airfoil 110 is known as the hi-C point.) Stress at this location is generally higher than surrounding locations. As such, a decrease in the depth of the damper pocket 200 at this location would assist in reducing overall bucket stress. Other shapes and depths may be used herein so as to accommodate the bucket 105 as a whole.

The pocket 200 also may have an angled surface 210 on one end. The angled surface 210 ensures proper installation of a damper pin as will be described in more detail below. The damper pocket 200 may be machined within the platform 120. Other types of manufacturing techniques may be used herein as will be explained in more detail below.

FIG. 2 shows the use of the bucket 105 with an adjoining bucket 220. Likewise, positioned within the damper pocket

200 may be a damper pin 230. As is shown, the damper pin 230 may be an elongated, generally triangularly shaped element with a pair of axially spaced bosses 240 on either end. The bosses 240 may be positioned on the support ledges 170. The damper pine 230 may have any convenient shape. The damper pin 230 is positional within the damper pocket 200 of the bucket 105 and underneath the angled surface 190 of the undercut 180 of the adjoining bucket 220. As is shown, the pocket 200 and the undercut 180 only partially enclose the damper 230. As such, it is possible to confirm that the damper pin 230 has been installed properly therein after assembly. The damper pin 230 also may have an angled surfaced 250 on one end. The angled surface 250 is designed to accommodate the angled surface 210 of the damper pocket 200 so as to ensure proper installation.

The damper pin 230 may have some play or space within the damper pocket 200 and the undercut 180. Once the bucket 100 obtains full speed, however, the damper pin 230 will engage the upper surface of the damper pocket 200 and the undercut 180 via centrifugal force such that both buckets 105, 220 are engaged. As such, the vibration of the buckets 105, 220 is dissipated by the contact between the damper pin 230 and the buckets 105, 220.

The damper pocket 200 thus radially and axially restrains the damper pin 230 in its proper position. Likewise, the support ledges 170 support the damper pin 230 when the bucket 105 is not rotating and under centrifugal force. The angled surface 210 of the damper pocket 200 also ensures proper installation of the damper pin 230. The variable tangential depth of the damper pocket 200 allows improved damping at the leading and trailing ends 160, 165 of the bucket 105 while minimizing the stress concentrations at the hi-C location.

Figure 3:
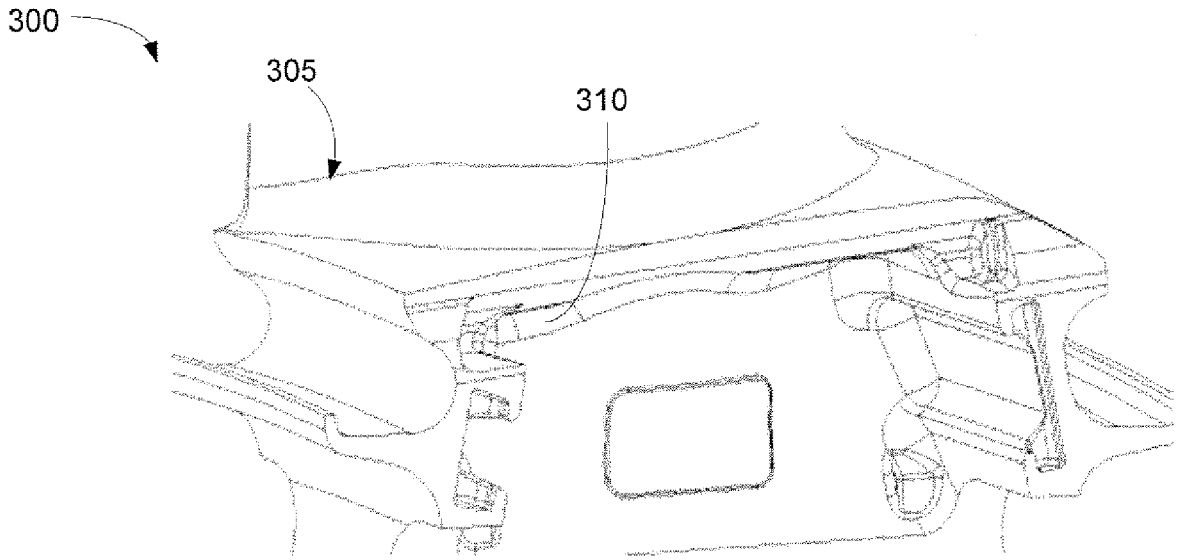
FIG. 3 is a perspective view of an alternative embodiment of a bucket vibration damping system as is described herein.
Figure 4:
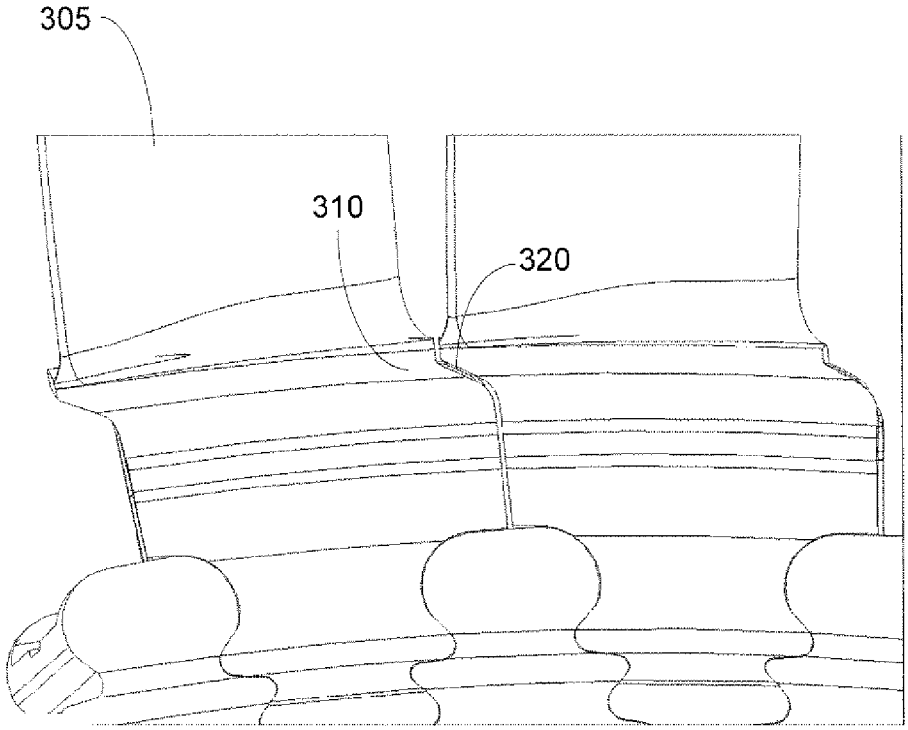
FIG. 4 is a side plan view of bucket vibration damping system of FIG. 3 as positioned within two adjoining buckets.

FIGS. 3 and 4 show a further embodiment of a bucket damping system 300 as is described herein. As above, the bucket damping system 300 includes a bucket 305 with a damper pocket 310. The damper pocket 310 is largely similar to the damper pocket 200 with the exception that the damper pocket 310 is cast as opposed to machined. The bucket pocket 310 also fully encloses the damper pin 230. Specifically, the damper pocket has an enclosure 320 on the leading end 160 and on the trailing end 165. The enclosures 320 restrain the damper pin 230 axially and also minimize the cross shank leakage area. The damper pin 230, however, can still be seen so as to allow visual inspection and confirmation that the damper pin 230 has been properly installed.

It should be readily apparent that the foregoing relates only to the preferred embodiments of the present application and that numerous changes and modifications may be made herein by one of ordinary skill in the art without departing from the general spirit and scope of the invention as defined by the following claims and the equivalents thereof.

We claim:

1. A damping system for a turbine bucket, comprising:

an airfoil;

a damper pocket positioned about the airfoil;

the damper pocket extending from a leading edge to a trailing edge;

the damper pocket comprising a variable tangential depth in a direction perpendicular to a length of the airfoil that is greatest at the leading edge and the trailing edge and least about the high C point of the airfoil; and a damper pin positioned within the damper pocket.

2. The damping system of claim 1, wherein the bucket comprises a convex side and wherein the damper pocket is positioned on the convex side.

3. The damping pocket of claim 1, wherein the bucket comprises a concave side and wherein the bucket comprises an undercut on the concave side.

4. The damping system of claim 3, wherein the undercut comprises an angled surface.

5. The damping system of claim 1, wherein the bucket comprises a pair of supports positioned about the damper pocket.

6. The damping system of claim 1, wherein the damper pocket comprises a pocket angled surface and wherein the damper pin comprises a pin angled surface.

7. The damping system of claim 1, wherein the damper pocket is machined into the bucket.

8. The damping system of claim 1, wherein the damper pocket is cast into the bucket.

9. The damping system of claim 8, wherein the damper pocket comprises a pair of enclosures.

10. The damping system of claim 1, wherein the damper pin comprises a pair of bosses.

* * * * *